US007258592B2

(12) United States Patent
Colak

(10) Patent No.: US 7,258,592 B2
(45) Date of Patent: Aug. 21, 2007

(54) SANTA CLAUS VISIT KIT

(76) Inventor: John I. Colak, 14020 - 120 St., Edmonton, Alberta (CA) T5X 4X8

( * ) Notice: Subject to any disclaimer, the term of this patent is extended or adjusted under 35 U.S.C. 154(b) by 214 days.

(21) Appl. No.: 10/926,815

(22) Filed: Aug. 26, 2004

(65) Prior Publication Data

US 2006/0046603 A1 Mar. 2, 2006

(51) Int. Cl.
*A63H 3/52* (2006.01)
*A63H 33/30* (2006.01)

(52) U.S. Cl. ..... 446/487; 446/476; 446/478

(58) Field of Classification Search ..... 446/476, 446/477, 478, 487
See application file for complete search history.

(56) References Cited

U.S. PATENT DOCUMENTS 5,096,752 A * 3/1992 Wagner ..... 428/13
5,394,989 A 3/1995 Delson
5,522,507 A 6/1996 Cruz
6,146,238 A * 11/2000 Daiber ..... 446/478
6,186,553 B1 * 2/2001 Phillips et al. ..... 283/2
6,763,975 B1 7/2004 Lesher
6,764,372 B1 7/2004 Rae
2002/0128081 A1 9/2002 Clarke et al.

FOREIGN PATENT DOCUMENTS

CA 1005986 12/1974
CA 2254402 11/1998

* cited by examiner

*Primary Examiner*—Eugene Kim
*Assistant Examiner*—Urszula M Cegielnik
(74) *Attorney, Agent, or Firm*—Harold L. Marquis; George W. Thomas; James W. Kayden

(57) ABSTRACT

A kit for creating an illusion that suggests a Santa Claus visit in a premises is disclosed. The kit includes items revealed to a child audience. These items include a displayer at which small items can be placed, and amusement items for use by at least a member of the child audience in carrying out steps that the child audience is invited to believe will assist Santa Claus in making the visit. The kit also includes items at least temporarily concealed from the child audience. The concealed items include means for making boot print resembling marks to mark an illusionary trail of Santa Claus in the premises.

10 Claims, 3 Drawing Sheets

SANTA CLAUS VISIT KIT

FIELD OF THE INVENTION

The present invention relates to Christmas items for entertaining children and, in particular, a kit for creating an illusion that suggests a Santa Claus visit in a premises.

BACKGROUND OF THE INVENTION

Various types of kits and items have been manufactured for carrying out plays, games and other types of childhood amusements. Some of these kits and items are intended to be used during special periods of the year such as Christmas, Easter and Halloween. These particular kits and items are often sold alongside holiday decorations and seasonal ornamentation.

Abandoned U.S. patent application pub. No. 2002/0128081 of Clarke et al. published Sep. 12, 2002, discloses a holiday kit for entertaining children. Embodiments of the kit include a Christmas kit and an Easter kit. The Easter kit includes a container for "bunny food" and a rabbit pawprint maker, in the form of a stamp. A different embodiment of the kit includes a container for "reindeer food" and reindeer hoofprint maker, also in the form of a stamp. According to one method of use disclosed in this published application, children who have awoken on Christmas day can be led to believe that Santa and his reindeer have visited due to the presence of hoofprints and a personalized note from Santa Claus in their house.

U.S. Pat. No. 5,522,507 of Cruz issued Jun. 4, 1996 discloses a kit for enacting the Tooth Fairy fable. A pillow case disclosed in this patent has a front pocket. This pocket is for temporary reception of a baby tooth. The parent of a child can remove the tooth from the front pocket while the child is sleeping. A container of dispensable gold-colored powder is also disclosed in this patent. The powder is dispensed to indicate the recent presence of the Tooth Fairy.

U.S. Pat. No. 5,394,989 of Delson issued Mar. 7, 1995 discloses a toy castle having a hidden storage compartment. A child's baby tooth can be placed inside a cloth sack that fits inside the compartment. The toy castle is a keepsake that can serve as a memento for the coming of the Tooth Fairy.

Known holiday kits for entertaining children have inadequacies. For example, many holiday kits do not facilitate sufficient interaction between parents and their children, or do not contain items that allow the child to participate in an activity that is connected with the holiday in a manner in which the child would believe that their actions brought about a special event. Also, many kits do not address common worries that children experience in conjunction with the holiday, such as the fear that Santa Claus might not leave presents at their house. Furthermore, many holiday kits do not take into account the fact that children can have relatively short attention spans, and in consequence the items in these holiday kits are likely to hold the interest of a child for only a short period of time.

It is an object of the present invention to provide an improved kit for creating an illusion that suggests a Santa Claus visit in a premises.

SUMMARY OF THE INVENTION

According to one aspect of the invention, there is provided a kit for creating an illusion that suggests a Santa Claus visit in a premises. The kit includes items revealed to a child audience. These items include a displayer at which small items can be placed, and amusement items for use by at least a member of the child audience in carrying out steps that the child audience is invited to believe will assist Santa Claus in making the visit. The kit also includes items at least temporarily concealed from the child audience. The concealed items include means for making boot print resembling marks to mark an illusionary trail of Santa Claus in the premises.

In a preferred embodiment, the displayer includes a Christmas diorama that, when assembled, at least partly bounds a region in which said small items are intended to be placed.

According to another aspect of the invention, there is provided a Christmas kit including items revealed to a child audience. The revealed items include a displayer at which small items can be placed, and amusement items for use by at least a member of the child audience in carrying out steps that the child audience is invited to believe will assist Santa Claus in making a visit. The Christmas kit also includes items at least temporarily concealed from the child audience. The concealed items include a lifelikeness enhanced image card that the child audience is invited to believe will allow Santa Claus to observe the child audience. The card is removably and visibly attachable to the diorama.

In a preferred embodiment, the concealed items further include a letter professing to be from Santa Claus, placeable at the displayer.

According to another aspect of the invention, there is disclosed a method for creating an illusion that suggests a Santa Claus visit in a premises, using a kit which includes items revealed to a child audience, the revealed items including a Christmas diorama that, when assembled, bounds a region in which small items are intended to be placed, and amusement items for use by a child audience in carrying out steps that the child audience is invited to believe will assist Santa Claus in making said visit, the amusement items including a toy key and packaged glitter. The kit also includes items at least temporarily concealed from the child audience, the concealed items including a boot print stencil to mark a trail of Santa Claus, a card removably attachable to said diorama, and a letter professing to be from Santa Claus. The method comprises the steps of:

(1) assembling the Christmas diorama;
(2) attaching the card to the diorama outside the presence of the child audience;

before the child audience has gone to sleep on Christmas Eve, and in front of the child audience:

(3) sprinkling contents of said packaged glitter outside the premises;
(4) placing the toy key outside the premises;
(5) placing a snack within the region;

outside of the child audience on Christmas Eve:

(6) marking the premises with the marking means to signify a recent presence of Santa Claus;
(7) removing at least a portion of the snack;
(8) leaving the letter professing to be from Santa Claus in the region; and
(9) removing the card from the diorama.

The Christmas kit according to the present invention facilitates interaction between parents and their children so as to create a memorable experience in connection with Christmas.

The Christmas kit according to the present invention can be used in a manner that may assist in alleviating a child's fear that Santa Claus might not leave presents at his or her house.

BRIEF DESCRIPTION OF THE DRAWINGS

These and other advantages of the invention will become apparent upon reading the following detailed description and upon referring to the drawings in which.

Figure 1:
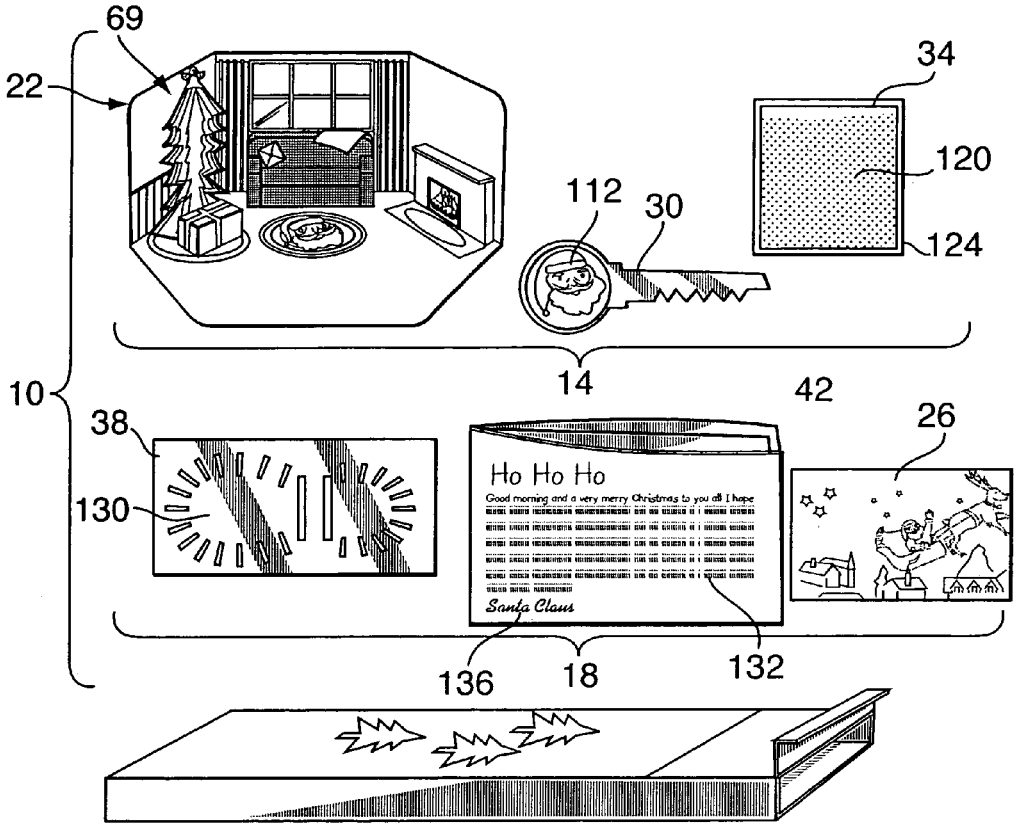
FIG. 1 is a perspective view illustration of an embodiment of the Christmas kit of the invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

A kit 10 for creating an illusion that suggests a Santa Claus visit in a premises is illustrated in FIG. 1. The kit 10 contains items 14 revealed to a child audience and items 18 kept concealed from the child audience. The items 14 include a Christmas diorama 22, a toy key 30 and a package of glitter 34. The items 18 include a boot print stencil 38, a rectangular card or insert 26 and a number of letters 42.

Figure 2:
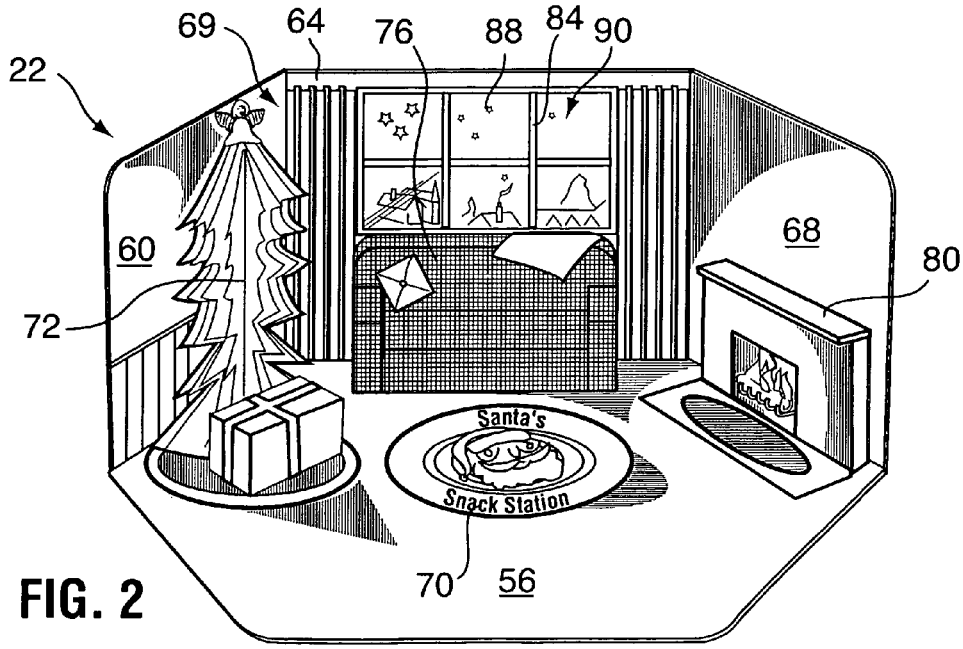
FIG. 2 is a perspective view illustration of a diorama and the diorama being one of the items of the kit of FIG. 1.
Figure 3:
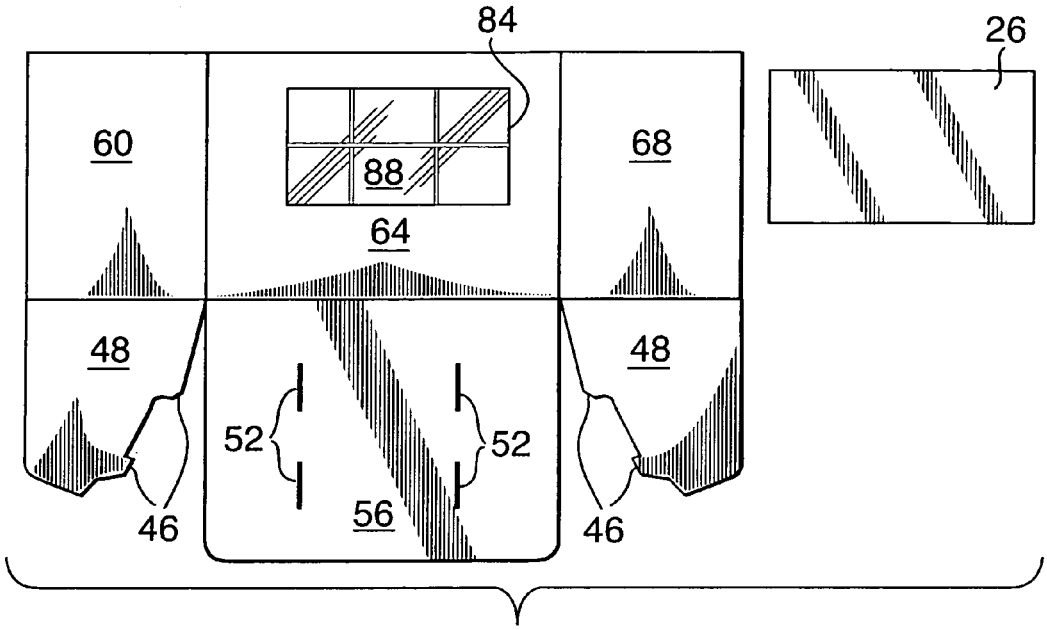
FIG. 3 is another perspective view illustration of the diorama of FIG. 2, the diorama being shown in an unassembled state, with an uninserted insert also shown.

FIGS. 2 and 3 illustrate the diorama 22 in an assembled and unassembled state respectively. A diorama is a three-dimensional representation of a scene, usually miniature like the diorama 22. In a diorama, inanimate objects and/or lifelike figures are arranged in front of a two-dimensional background scene drawn, printed or painted in perspective on a flat or curved surface to create the illusion of greater depth of field than actually exists. Dioramas are particularly enjoyed by children, and the concept of the diorama has been incorporated into so called "pop-up" books for children.

Two locking tabs 46 are formed on each of flaps 48 (FIG. 3). The diorama 22 is assembled by inserting the tabs 46 into slots 52 formed in horizontal panel 56. Inserting the tabs 46 into the slots 52 urges the diorama 22 into the configuration shown in FIGS. 1 and 2. It will be understood however that the tabs 46 and the slots 52 are not crucial to the assembly of the diorama 22. For example, translucent tape could be used to attach the flaps 48 to the horizontal panel 56.

When the diorama 22 is assembled and properly placed on a horizontal surface, side vertical panel 60, middle vertical panel 64 and side vertical panel 68 extend in a substantially vertical direction. Also it is possible for a drink or a snack to be placed on top of the horizontal panel 56. Preferably the drink or snack should not be too large because it is ideally placed in a region 69 partly bounded by the diorama 22, and in particular the region 69 is partly bounded by the panels and the flaps of the diorama 22.

Indicia 70 provides means for indicating that a snack should be placed at the diorama 22 on Christmas Eve. In an alternative embodiment of the diorama, there is a plurality of indicia for indicating spaced apart locations to place different small items. One of these indicia includes the words "Place Cup Here", and another of these indicia includes the words "Place Plate Here".

The background printed on the panels 60, 64 and 68 in the illustrated embodiment is that of walls of a living room of a house decorated for Christmas. Christmas tree representation 72, sofa representation 76 and fireplace representation 80 are the three-dimensional objects of the diorama 22. These objects can be made of cardboard with a plurality of folds to provide a sense of three dimensions. Alternatively the objects can be plastic models placed within the region 69.

It will be understood that other types of diorama backgrounds that are appropriate for a Christmas theme could be used. For example, the background could be a toy workshop instead of a living room. In this case, the three-dimensional objects for the diorama would likely be objects one would associate with this particular background, such as a toy making machine.

A window frame representation 84 is printed on the diorama 22. An outdoor scenery image 88 is within the window frame representation 84, and the image 88 in combination with the representation 84 gives a person looking at the diorama 22 the impression that there is a window. The window is made more lifelike by timely use of the insert 26 in an open pocket 90 formed between the window frame representation 84 and the window image 88, access to this pocket 90 being provided for example at the back of middle panel 64.

The interpretation of the noun "insert" is not to be limited to something that is inserted in the context of this application. Insert in the context of this application can also mean a printed sheet, regardless of whether or not it is actually inserted into a pocket 90. Although a pocket 90 is the preferred attachment means for the insert 26, the insert 26 could be attached to the diorama 22 by means of clips, for example.

The insert 26 is a lifelikeness enhanced image card having approximately the same length and width dimensions as the outdoor scenery image 88. These dimensions permit the insert 26 to cover up the image 88, replacing the image 88 with the image printed on the insert 26. In one embodiment the image printed on the insert 26 is substantially the same as the image 88, except that the image printed on the insert 26 includes (for example) Santa Claus flying through the sky on his sleigh. Preferably the insert 26 is inserted on Christmas Eve before the child audience has awoken so as to create the illusion that the diorama 22 has a "magic window" permitting Santa Claus to be seen while he is delivering presents to children all over the world on Christmas Eve. The child audience can be told that just as they can see Santa Claus, so too can Santa Claus see them. This insert is preferably removed before the child audience awakes Christmas morning, leaving only the original image 88 of the diorama.

In one embodiment, the image printed on the insert 26 is a holographic three-dimensional image. In particular, the image can be of the type which changes as the card is tilted or the card is observed from a different angle. In this way the position of Santa Claus will change as the insert 26 is observed from different angles, and it may appear to a child observing Santa Claus through the "magic window" that Santa Claus is moving.

Figure 4:
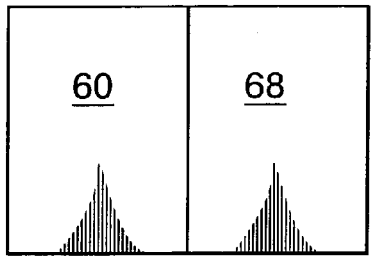
FIG. 4 is yet another perspective view illustration of the diorama of FIG. 2, the diorama being shown in a collapsed state suitable for storage.

The diorama 22 can be folded up as illustrated in FIG. 4. This permits the kit 10 to be put away and stored in a relatively flat and compact box after Christmas is over.

It will be appreciated that the kit of the present invention need not include a diorama. Any kind of displayer at which small items can be placed is sufficient. For example the displayer could be a miniature erectable sign, and the item(s) could be placed in front of the sign.

The toy key 30 is illustrated in FIG. 1 can be made of a variety of different materials including metal. It is preferably sufficiently large so that it will not be swallowed by young children. An image 112 of Santa Claus is imprinted on base 116 of the toy key 30.

The packaged glitter 34 is illustrated in FIG. 1 glitter 120 contained in plastic packaging 124. The glitter powder 120 can be made of a variety of materials including PVC and aluminum, though preferably it is made from a non-toxic material in case it is swallowed by a child.

Figure 5:
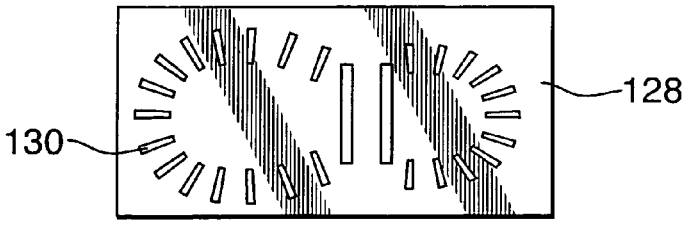
FIG. 5 is an illustration of a boot print stencil, the stencil being one of the items of the kit of FIG. 1.

The boot print stencil 38 is illustrated in FIG. 5. The stencil 38 is made of cardboard or other suitable material. Sheet of cardboard 128 has a plurality of holes punched in it. Boot print resembling marks can be created using the stencil 38. For example, the stencil 38 can be placed on a hardwood or tile floor and a material 130, such as washable paint can be sprayed over the apertures in the cardboard 128. Instead of washable paint, the material 130 may be any dry, fine powder, such as artificial snow, flour, baking powder, baking soda, baby powder, icing sugar or fine sparkles. Alternatively paper can be placed under the stencil 38, and then by using a marker, crayon or paint a boot print resembling mark can be made on the paper. This can be then be cut out and placed on or taped to a floor.

With respect to the letter 42, illustrated in FIG. 1, the letter text 132 consists of a message for the child audience. Signature 136 reads "Santa Claus". Thus, the letter 42 professes to be from Santa Claus. The kit 10 has a plurality of letters similar to each other except for the message, and thus the letter 42 used in a following year will not have the same message. It will be appreciated that alternative items could be used instead of the letter 42, and yet still achieve at least the desired acknowledging effect. For example, a DVD or video tape containing a video of a man dressed up as Santa Claus who delivers a message to the child audience could be used.

Figure 6:
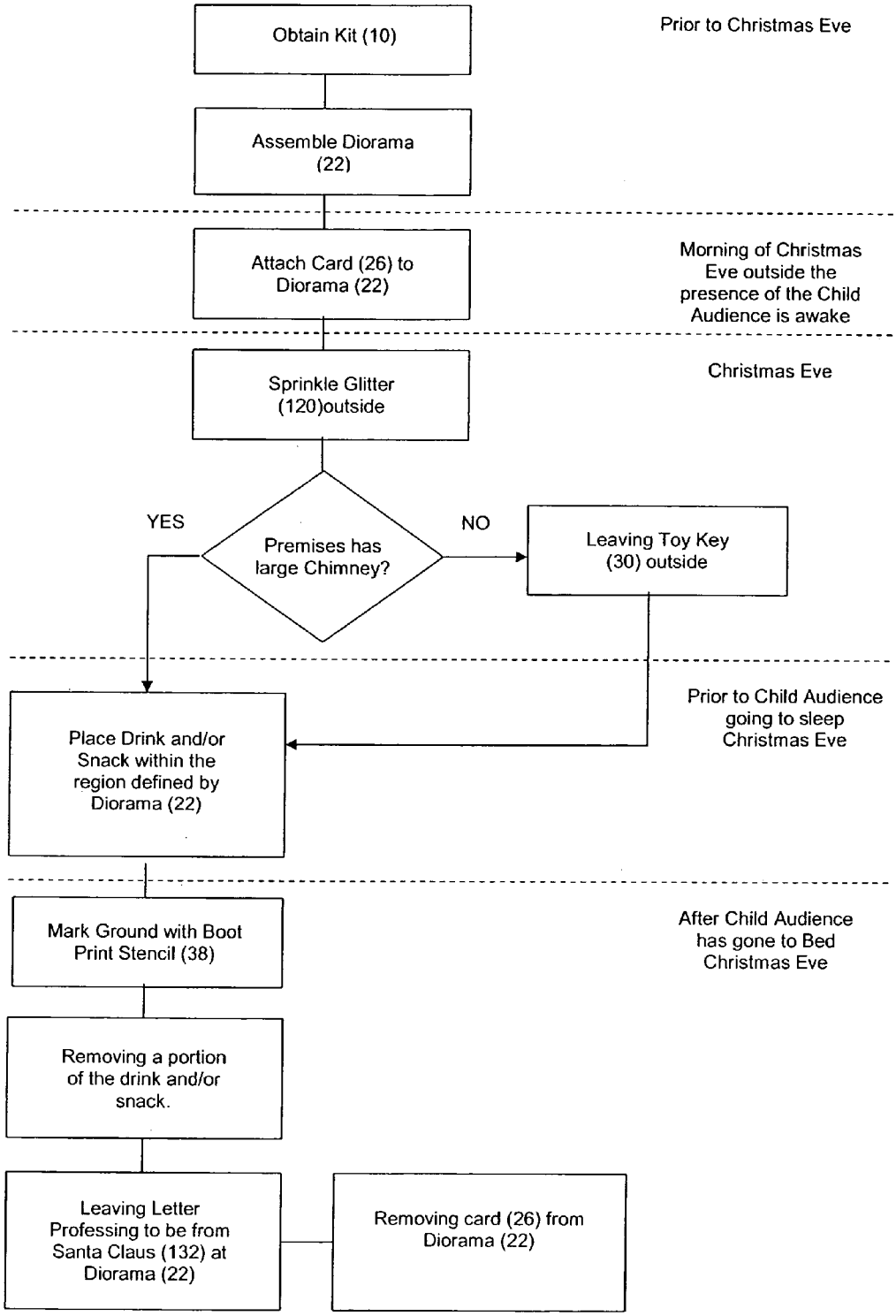
FIG. 6 is a flow diagram illustrating a method implementable by the kit of FIG. 1.

One embodiment of the method of using the kit 10 is illustrated in FIG. 6. Steps of the method are preferably carried out at different periods in time. These periods of time include prior to Christmas Eve, the morning of Christmas Eve before the child audience is awake, Christmas Eve when the child audience is awake, and a time period after the child audience goes to bed.

A step that occurs prior to Christmas Eve is obtaining the kit 10, which includes the diorama 22, the toy key 30, the package of glitter 34, the boot stencil 38, the insert 26, and the letters 42. An instruction sheet also accompanies the kit 10 which explains the kit 10 and the method of using the kit 10. It is understood that the method according to an embodiment of the invention requires that some articles, namely the boot stencil 38, the insert 26 and the letters 42 to be kept hidden from the child audience, at least for a period of time, in order to maintain the illusion that Santa Claus will visit and has visited the premises. Other articles, namely the toy key 30 and the package of glitter 34, are used to elicit the participation of the child audience to support the belief that Santa Claus will visit the premises.

The diorama 22 is used to provide a context to reinforce the Santa Claus visit and to provide a focal point for the child audience to associate the Santa Claus visit with the activities performed on Christmas Eve. The diorama 22 is set up in a place that is accessible to the child audience, and the child audience is told that the region bound by the diorama 22 is where a snack will be left for Santa Claus when he comes to visit the premises on Christmas Eve.

On the morning of Christmas Eve before the child audience is awake, the insert 26 is attached or inserted into the diorama 22. When the child audience is awake, the child audience's attention is drawn to the representation on the insert 26 of Santa Claus flying through the sky delivering presents, and the child audience is told that the insert 26 is a "magic window" that allows Santa Claus to see if the child audience is awake or asleep on Christmas Eve. The child audience is told that Santa Claus will not visit the premises until after the child audience is asleep. Because the insert 26 is lifelikeness enhanced, the child audience is further likely to believe that the diorama 22 has a "magic window".

To reinforce the child audience's belief that Santa will visit, the child audience is told to leave a drink and/or snack for Santa Claus, and to sprinkle the glitter powder 120 outside the premises to help guide Santa Claus' reindeer to the premises on Christmas Eve. It is understood that other articles could be used as alternatives to the glitter powder 120. For example, a container of dog food could be used if the child audience is told that the dog food is "reindeer food" which will encourage Santa's reindeer to visit the premises.

If the premises has no chimney or a small chimney, then the child audience is told to leave the toy key 30 outside the premises, as it is a "magic key" that only Santa Claus may use to successfully open the door of the premises. The image of Santa Claus 112 on the key 30 can be shown to the child audience to provide evidence that the key 30 is intended to be used by Santa Claus only.

On Christmas Eve, the child audience may be assisted in obtaining the traditional snack for Santa Claus, e.g. cookies and a glass of milk, the snack being placed on the horizontal panel 56 of diorama 22.

After the child audience is asleep on Christmas Eve, a portion of the snack is removed to create an illusion that Santa Claus has taken the removed portion. The boot stencil 38 is used to make boot prints on the ground as previously described, using paint or any dry, fine powder, such as artificial snow, flower, baking powder, baking soda, baby powder, icing sugar, or fine sparkles, to enhance the illusion that Santa Claus has visited the premises. The boot prints would lead to and from the diorama 22; however it is contemplated that discontinuous tracks and tracks leading to other areas of the premises can be sufficient. In addition to the boot tracks, a letter purporting to be from Santa is left in the region bound by the diorama 22 to further enhance the illusion that Santa Claus visited the premises. As previously mentioned, insert 26 is also removed from the diorama. The stage is now set for the child audience on Christmas morning.

Thus, it is apparent that there has been provided in accordance with the invention a Christmas kit that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim:

1. A kit for creating an illusion that suggests a Santa Claus visit in a premises, said kit comprising:

a) items revealed to a child audience comprising i) a displayer Christmas diorama that, when assembled, at least partly bounds a region in which small items can be placed, said diorama having a plurality of panels, a first image being imprinted on one of said panels;

ii) amusement items for use by at least a member of said child audience in carrying out steps that said child audience is invited to believe will assist Santa Claus in making said visit; and b) items at least temporarily concealed from the child audience, said concealed items comprising means for making boot print resembling marks to mark an illusionary trail of Santa Claus in said premises and a card having a second image, the second image being similar to the first image but also containing a representation of Santa Claus.

2. A kit as claimed in claim 1 wherein one of said panels comprises a pocket permitting said card to be inserted into said diorama, to superimpose said first image with said second image.

3. A kit as claimed in claim 1 wherein said first image is a scene as viewed from a window.

4. A kit as claimed in claim 1 wherein said second image is a holographic three-dimensional image.

5. A kit as claimed in claim 1 wherein said means for making boot prints comprises a stencil.

6. A kit as claimed in claim 1 wherein said amusement items further comprise a toy key.

7. A kit as claimed in claims 1 or 6 wherein said amusement items further comprise packaged glitter.

8. A kit as claimed in claim 1 wherein said concealed items further comprise a lifelikeness enhanced image card and a letter professing to be from Santa Claus, said card removably attachable to said diorama.

9. A kit as claimed in claim 1 wherein said amusement items further comprise packaged glitter.

10. A kit as claimed in claim 1 wherein said concealed items further comprise a letter professing to be from Santa Claus.

* * * * *